United States Patent [19]

Springer

[11] Patent Number: 5,012,863

[45] Date of Patent: May 7, 1991

[54] PIPE MILLING TOOL BLADE AND METHOD OF DRESSING SAME

[75] Inventor: Johann Springer, Hanover, Fed. Rep. of Germany

[73] Assignee: Smith International, Inc., Houston, Tex.

[21] Appl. No.: 350,976

[22] Filed: May 12, 1989

[30] Foreign Application Priority Data

Jun. 7, 1988 [GB] United Kingdom ..... 8813452
Sep. 21, 1988 [GB] United Kingdom ..... 8822134

[51] Int. Cl.[5] ..... E21B 29/00; B23D 21/14

[52] U.S. Cl. ..... 166/55.7; 175/379; 175/403; 175/410; 30/103; 407/53; 408/203.5

[58] Field of Search ..... 166/55, 55.6, 55.7; 175/402, 403, 330, 379, 410; 30/103-105; 407/53, 54; 408/200, 203.5, 223, 224, 227, 231

[56] References Cited

U.S. PATENT DOCUMENTS 2,833,520 5/1958 Owen ..... 175/379
2,846,193 8/1958 Chadderon ..... 166/55.7
3,106,973 10/1963 Christensen ..... 175/330
3,726,351 4/1973 Williams, Jr. ..... 175/403
4,128,136 12/1978 Generoux ..... 175/403
4,719,979 1/1988 Jones ..... 175/379

*Primary Examiner*—Bruce M. Kisliuk
*Attorney, Agent, or Firm*—Robert G. Upton

[57] ABSTRACT

A blade (8) for a pipe milling tool having a body (1) and a longitudinal axis (100) has a plurality of slots (12) extending both in a generally radial direction and in an intended direction of rotation of the milling tool about the longitudinal axis. Located in each slot (12) is at least one cutting element (13), the slot and the cutting element both having a greater depth in the blade in the intended direction of rotation than height in the longitudinal axis direction. The provision of such dimensions for the slot and cutting element affords the blade with improved life. The cutting elements may each have a negative axial rake angle (A) and the cutting elements are preferably brazed in each of the slots. In a preferred embodiment the slots and the cutting elements are both similarly decreasingly tapered from a forward (leading) face (221) to a rearward face (218) with respect to the intended direction of rotation of the tool by an angle in the range 1° to 20°.

24 Claims, 6 Drawing Sheets

PIPE MILLING TOOL BLADE AND METHOD OF DRESSING SAME

FIELD OF THE INVENTION

This invention relates to a blade for a pipe milling tool and to a method of dressing such a blade, the blade normally being used with a milling tool for cutting or milling tubular members and other basically cylindrical obJects employed in energy exploration, for example in an oil or gas well or the like.

BACKGROUND OF THE INVENTION

Oil and gas wells are usually lined with a steel pipe forming a casing which may hang freely or may be cemented in position by pumping a cement slurry between the outer surface of the pipe and a bore hole in which the pipe is located. In certain circumstances it may be necessary or desirable to cut the casing by milling at a distance from the well surface and to mill away a substantial length of pipe. Milling may be required, for example, to remove cemented casing so that a well can be redrilled or to remove a section of the casing to improve or permit oil and gas production at a desired elevation in a well.

It is known to use milling tools having either fixed or hydraulically radially expandable cutting blades. Known fixed diameter mills usually have a plurality of fin like cuttingblades radially projecting outwardly from a tubular body and the fins may be welded, brazed or bolted to the mill body. Known hydraulically activated mills have a plurality of cutting blades, often called 'knives', that are circumferentially disposed about a mill body and are pivotally attached to the body at an upper end of the blades so that the lower end of the blades may be swung radially outwardly when the mill has reached a desired location within the casing at which milling is to commence. A usual manner of radially opening the blades is by a reciprocally operable piston located within a longitudinal bore within the mill body, the piston being operable by circulation of drilling mud to force the piston downwardly. The piston is arranged to contact a cam surface on the blades to pivotally rotate the lower, in operation, end of the blades radially outwardly and thereby wedge the blades into contact with the casing to be milled. The mill body is connected to a drill string and the string is rotated to effect milling, the blades being maintained in the open position by the hydraulic action of the drilling mud on the piston.

Another type of milling tool is that known as a washover shoe which is a fixed diameter mill having a tubular body with cutting elements disposed around the lower periphery of the body. A washover shoe is used to mill away tool obstructions such as stabiliser ribs, reammer cutters, expanded packers and bit bodies which may be retaining a drill string downhole. By using a number of wash pipes, the rotatable washover shoe is passed over the drill string and lowered to the position of the obstruction so that, in effect, the washover shoe cuts an annulus.

It has been conventional to use fragments of crushed tungsten carbide secured in a layer of brazing alloy on the part of the blade which, during rotation thereof, is the leading face i.e. that portion of the blade which is forwardly facing during rotation. The brazing process leaves particles of carbide in a more or less randomly distributed fashion and orientation in the brazing alloy.

Such random orientation of the tungsten carbide fragments and hence the cutting edges of the fragments significantly limits the milling efficiency of the tool and creates mainly undesirably long cuttings which may cause the mill or the drill string to become stuck. The total amount of tungsten carbide fragments available for milling is limited by the need to have a supporting matrix of brazing alloy.

So as to overcome the problems associated by the random orientation and distribution of the tungsten carbide fragments, mills have been constructed with geometrically shaped cutting elements and such a mill is disclosed in U.S. Pat. No. 4,710,074 assigned to Smith International Inc. In such a mill the blades have a leading cutting edge on which is secured tungsten carbide cutting elements across the leading face of the blade in a radial row and there being a plurality of rows extending in the longitudinal direction of the axis of the milling tool. The total number of cutting elements that can be used on such a milling blade is limited to the surface area of the radial cutting blade. The cutting elements have a rectangular cross section in the longitudinal, axial, direction with the depth of each element in the rotational direction being significantly less than the height of each element in the longitudinal axial direction. The leading face of the elements is either parallel to the longitudinal axis of the mill body or tilted such that the upper edge in use of each element is inclined forwardly of the lower edge of said element to provide what is known as negative axial rake. The provision of such negative axial rake is believed to provide more efficient cutting and to provide shorter cuttings that can be circulated out of the well more conveniently by drilling mud. The tungsten carbide elements are usually secured to the front, i.e. leading, face of the mill by brazing but the complete front face of the cutting elements is unprotected against axial, torsional and radial shocks that are frequently encountered during casing milling operations. The tungsten carbide elements therefore tend to crack and break off the cutting blades which, it will be realised by those skilled in the art, limits the distance that can be milled with a single mill and which can be milled in a continuous operation.

SUMMARY OF THE INVENTION

The present invention seeks to provide a blade for a pipe milling tool, and a method of dressing such a blade in which the foregoing defects are substantially mitigated.

According to one aspect of this invention there is provided a blade for a pipe milling tool adapted to be connected to a rotatable drilling string body having a longitudinal axis, said blade having at least one slot means formed therein extending both in a generally radial direction and in an intended direction of rotation, and at least one cutting element secured in each said at least one slot means, said slot means and said cutting element having a greater depth in said blade in the intended direction of rotation than height in the longitudinal axis direction.

The provision of a slot means in the blade having a greater depth in the intended direction of rotation than height in the longitudinal axis direction has the dual advantage that not only is the cutting element more securely located within the blade but by virtue of providing a cutting element having a greater depth than height so when the leading edge of the cutting element breaks off in use there remains a greater depth of cutting element for subsequent use in milling so that the blade lasts for a longer period of time which in turn means that a longer length of pipe can be milled.

The ratio of depth to height of the slot means and of the cutting element may be in the range 1.2:1 to 8:1 and in a preferred embodiment the ratio of depth to height is in the range 2:1 to 4:1.

The sides of the slots in the front to back direction of intended rotation of the tool, i.e. the top and bottom of the slots in the longitudinal, axial direction of the tool, may be parallel to one another and the front to back sides of the cutting elements may be similarly parallel to one another but of smaller dimensions so that the cutting elements fit into the slots and are secured therein by, for example, brazing material. Such a construction requires that the slots are accurately cut to a narrow tolerance so that the brazing material in which the cutting elements sit in the slot does not have an excessive thickness. It has been found that with such a construction there is a tendency for a cutting element to fracture in use caused by tensile stresses in the brazing material contracting during cooling after use and such contraction of the brazing material causes the cutting element to tear apart. In a preferred embodiment of the invention it is accordingly provided that the slot means and the cutting element are both similarly decreasingly tapered from a forward to a rearward face with respect to the direction of the intended rotation of the tool at an angle in the range 1° to 20°, preferably 3° to 6°.

By providing the blade with a tapered slots and rendering the cutting elements similarly tapered so the advantage is achieved that tensile stresses in the brazing material in which the cutting element is mounted is reduced.

Advantageously said at least one cutting element has a cutting surface presenting a negative axial rake angle whereby an upper edge of the cutting surface is tilted towards the direction of body rotation. Advantageously the negative axial rake angle is in the range 2°-20° and preferably is in the range 10°-15°.

Preferably a plurality of slot means are provided located one above the other in the direction of the longitudinal axis and advantageously a plurality of cutting elements are radially located in each said slot means. In such an embodiment, preferably adjacent cutting elements above one another to provide a substantially continuous cutting edge.

Conveniently each cutting element has a quadrilateral cross section when viewed along the longitudinal axis and such cross section is conveniently rectangular or square.

The cutting elements may be made of tungsten carbide, industrial diamond, ceramics or boron nitride.

The blade is normally radially connected to the body and may be fixedly attached to the body by for example welding, brazing, rivetting or bolting or the blade may be pivotally radially connected to the body with means being provided for radially extending the blade.

In a feature of this invention a washover shoe has a tubular body and a plurality of blades, each of the blades being as defined above in said one aspect and positioned around the lower periphery of the body. Such a washover shoe advantageously has the slot means of adjacent blade means presenting different angles to one another with respect to a plane perpendicular to said longitudinal axis so that differing axial rake angles are produced.

According to a further aspect of this invention there is provided a method of dressing a blade for a pipe well milling tool having a body with a longitudinal axis, said body being adapted to be connected to a rotatable drilling string, said method including the steps of forming at least one slot means in the blade in a generally radial direction to said longitudinal axis and in an intended direction of rotation of said blade, said slot means having a greater depth in the intended direction of rotation than height in the longitudinal axis direction, inserting at least one cutting element into said slot means, said cutting element having similar depth and height dimensions to said slot means, and securing said cutting element into said slot means.

The cutting elements, by being inserted into slots, are protected against shocks and each cutting element tends to have a longer life before it fails and breaks. The new cutting surface created after a small chip of the cutting element is broken off, is approximately parallel to the initial rake angle of the cutting face and the behaviour of the milling tool remains unchanged as a cutting element gradually wears. Furthermore, the total number of tungsten carbide elements that can be attached to a milling blade of predetermined size is greater when the elements are inserted into slots than on prior art mills where the leading or trailing face of the cutting elements are simply brazed onto the surface of the milling blade. The slower wear rate and increased amount of tungsten carbide on each blade increases the length of tubular pipe sections that can be milled without pulling the milling tool from the well, replacing the blades and running back into the well, therefore the cost of milling operations is significantly reduced by the present invention.

Although a plurality of slots located longitudinally one above another are preferred it is to be understood that a single slot could be used.

The invention will now be described by way of example with reference to the accompaning drawings in which:

FIG. 1 shows a vertical cross-sectional view of a casing mill incorporating accordance with this invention, FIG. 2 shows a cross section along double arrow headed line II—II of FIG. 1.

FIG. 3 shows a cross section along double arrow headed line III—III of FIG. 1, FIG. 4 shows a vertical cross section of a section mill having hydraulically, pivotally, opening blades, FIG. 5*a* shows the milling action of three blades of FIG. 4 which open the remaining blades, FIG. 5*b* shows the milling action of all of the blades of FIG. 4, FIG. 6 shows a blade for use with the tool of FIG. 4, the blade being in accordance with this invention, FIG. 7 shows a cross-section along double arrow headed line VII—VII of FIG. 6, FIG. 8 shows a top plan view in the direction of arrow headed line VIII of FIG. 6, FIG. 9 shows a bottom plan view in the direction of arrow headed line IX of FIG. 6, FIGS. 10 and 11 are mutually orthogonal cross sectional views of a washover shoe incorporating blades of this invention in which FIG. 10 is a partial longitudinal cross-section along double arrow headed line X—X of FIG. 11 and FIG. 11 is a cross-section along double arrow head line XI—XI of FIG. 10, FIG. 12 is a partial developed view along the outside diameter of the washover shoe of FIGS. 10 and 11, FIG. 13 shows a part view in the direction of double arrow headed line XIV—XIV of FIG. 12, FIG. 14 shows a part view in the direction of double arrow headed line XV—XV of FIG. 12, FIG. 15 shows a part view in the direction of double arrow headed line XVI—XVI of FIG. 12, FIG. 16 is a part view of the portion encircled XVII of FIG. 12, FIG. 17 shows a cross section along double arrow headed line XVIII—XVIII of FIG. 1 or FIG. 6 indicatinq a defect that can occur, FIGS. 18 and 19 each show a cross section along double arrow headed line XVIII—XVIII of a preferred blade.

In the figures like reference numerals denote like parts.

DETAILED DESCRIPTION

Figure 1:
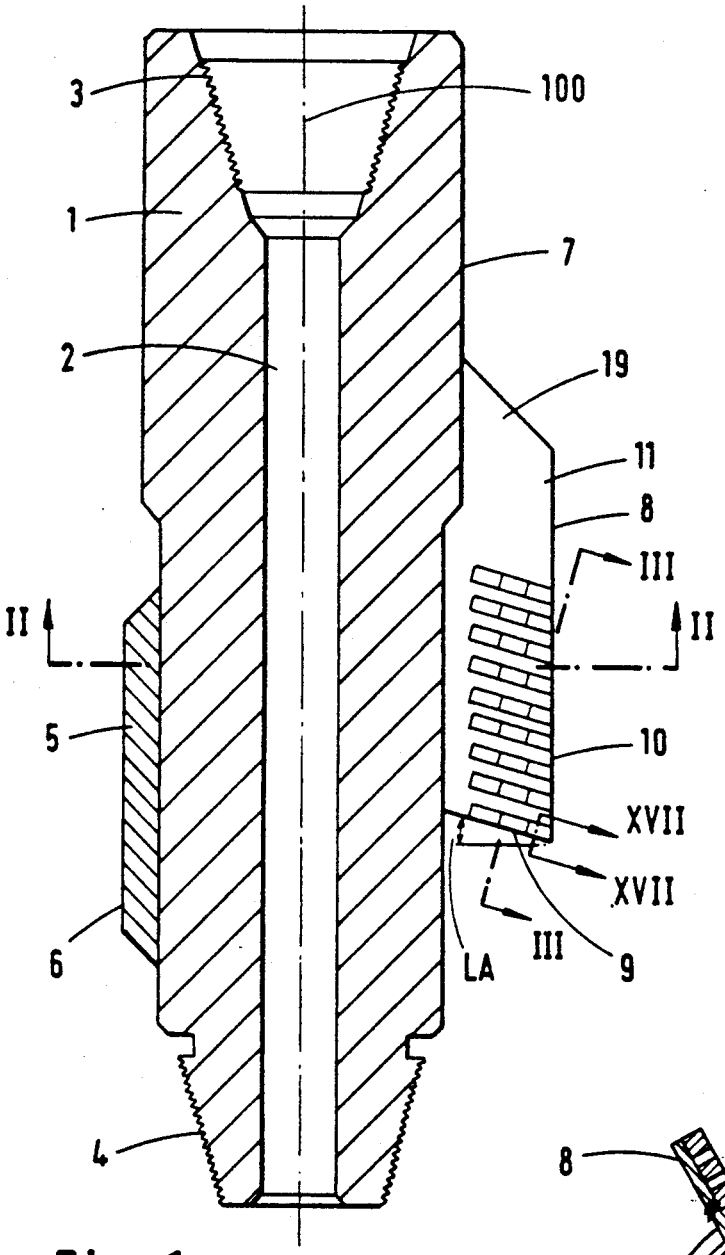
Figure 3:
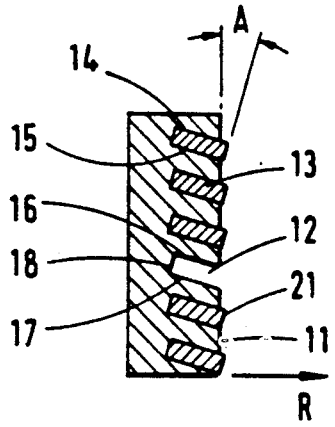
Figure 2:
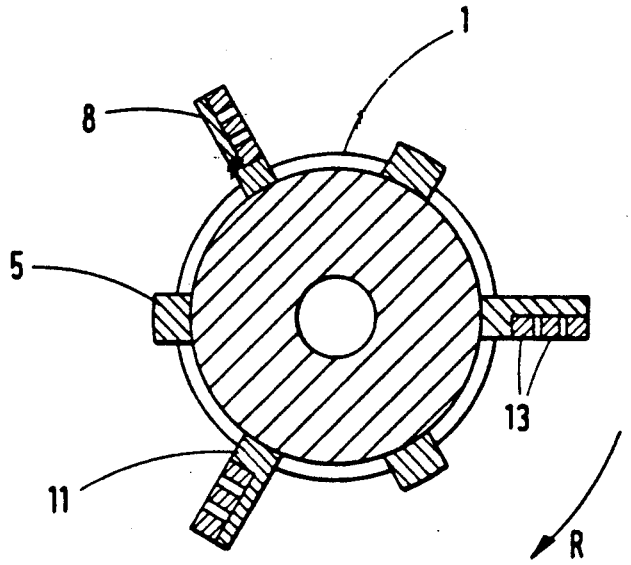

A casing mill, shown in FIGS. 1, 2 and 3, is used to remove a length of steel casing from a well bore. The mill has a circularly cross-sectioned body 1 having a longitudinal axis 100 and a longitudinal bore 2 through which mud may be circulated for removal of milled cuttings which are carried upwardly between an annulus created between the mill and the casing or well bore in which the mill is located. The upper, in use, end of the mill is provided with an internal tapered screw thread 3 for threadably securing the mill to a drill string and the lower, in use, end of the mill is provided with a tapered external screw thread 4 to couple the mill to lower drill string elements as is well known.

So as to pilot the mill coaxially into and along a pipe or casing three or more radially extending vanes 5 are provided equi-circumferentially spaced around the body 1. The radially outer edge of the blades 5 is dressed with tungsten carbide 6 to reduce wear on the vanes. A fishing neck 7 is defined between the top of the body 1 and the top edge of three equi-circumferentially spaced radially extending blades 8. The blades 8 are disposed longitudinally along the middle of the body and may have a lower extent above, at the same level, or below (as shown) the top of the vanes 4. Each blade 8 may be brazed, welded, rivetted or bolted to the body 1 and each blade projects radially outwardly from the body 1 more than the radial extent of the vanes 4 to present a cutting edge 9 on a lower edge of the blade 8. The lower edge 9 may have a radially outer end inclined downwardly with respect to a radially inner end of the blade 7 to provide a lead attack angle LA in the range 0–°15°, preferably 10°. Each blade 8 has a radially outer edge 10-which defines the radially outermost periphery of the mill and which is arranged to have a slightly greater radius than the radius of the pipe or casing if only the pipe or casing is to be milled away or is close to the outer radius of a coupling that connects joints of pipe or casing if both pipe or casing and coupling are to be milled away. It will be appreciated that the blades 7 may have any desired length depending upon the length of casing to be milled.

The mill, in use, is arranged to be rotated in a right hand direction and axially loaded to cut away the pipe or casing. The blades thus each have a leading or forward face 11 and in the embodiment shown, the face 11 is parallel with the longitudinal axis 100.

The leading face 11 of each blade is provided with nine equally spaced slots 12 located one above another in the longitudinal axial direction and each of the slots 12 extends in a generally radial direction and from the leading face rearwardly with regard the intended direction of rotation of the tool as shown in FIG. 3 so that each slot is a 'blind' slot. The slots each have parallel upper 16 and lower 17 surfaces and a trailing or rearward edge 18.

As shown in FIG. 3 each slot is inclined downwardly from the rearward, blind, end to the open, leading (forward) end in the intended direction of rotation and located side by side in each slot are three quadrilateral, preferably square, cross-sectioned tungsten carbide cutting elements 13 having parallel upper faces 14 and lower faces 15 corresponding to the parallel upper 16 and lower 17 surfaces of the slot 12. One of the slots is shown empty in FIG. 3 for explanatory purposes only. Each of the elements 13 are secured in the respective slot by brazing material adjacent surfaces 16, 17, 18. The difference between the longitudinal height of the cutting elements and the corresponding height of the slot 12 into which the elements are secured depends upon manufacturing tolerances of the elements 13 and the gap requirements for the particular bonding material that is used to secure the elements in the slots. In this respect material other than brazing material may be used although brazing material is currently preferred. The slots extend radially inwardly to a radius less than the outer radius of the outer edge of the vanes 5. A portion 19 of the upper end of each blade is left free of cutting elements to provide a positive indication of tool wear of the mill.

In the preferred embodiment each cutting element 13 has a square cross-section when viewed in the axial direction with a radial length, and a depth in the direction of rotation, i.e. from the leading edge to the rearward edge thereof, of 0.375 inches (9.5 mm) and a height in the longitudinal axial direction of 0.125 inches (3.2 mm), and each of the elements is made of tungsten carbide. The ratio of depth to height is thus preferably in the range 2:1 to 4:1 although the range may extend from 1.2:1 to 8:1. The cutting elements may alternatively be made from industrial diamond, ceramics or boron nitride.

The angle of inclination of the slots causes the cutting elements 13 which have minor surfaces which are substantially perpendicular to the major faces 14 and 15 to present a leading edge 21 which presents a negative axial rake angle A with respect to the plane of the longitudinal axis 100 which is in the range 2–°20° and preferably in the range 10°–15°. In the provision of a negative axial rake angle A it will be understood that the upper edge of the leading edge 21 is tilted toward the direction of body rotation R. The provision of such negative rake angle provides an improved cutting effect by producing shorter milled cuttings and by reducing the axial load required on the tool.

Because the cutting elements 13 have substantially the whole of their major planar surfaces securely inserted into the slots 12 so the cutting elements are protected against shocks and therefore each cutting element 13 cuts for a considerably longer time than on the prior art mills. When a small chip breaks off the leading edge of the cutting element, a new cutting edge of the element is exposed. The new cutting edge is more or less parallel to the initial negative axial rake angle A of the leading edge 21 so that the behaviour of the milling tool does not change as the cutting elements are slowly eroded during milling. The total amount of tungsten carbide that can be attached to a predetermined length of milling blade 8 is larger with this invention than when the front or back major planar surface of the cutting element is brazed onto the front face of a blade as in the prior art. The slower wear and the increased amount of tungsten carbide on the blades lead to longer sections that can be milled without pulling the mill from a well, replacing the mill and running the new mill into the well, thereby reducing the cost of milling operations.

In use the mill is rotated in the direction of arrow headed line R and when the mill is in a well bore and secured on a drill string so the leading cutting edge 21 of the blades 8 are bought into contact with the pipe or casing to be milled. While the mill is loaded axially and when the blades are milling, mud is pumped down through the drill string and through the bore 2 to circulate the cuttings out of the well.

By longitudinally spacing the rows of cutting elements 13 on each blade so if one or more of the cutting elements or rows of cutting elements is consumed in use so a fresh cutting element or row of cutting elements is presented for cutting.

Another type of milling tool in which the present invention may be utilised will now be described with reference to FIG. 4 which shows a so called section mill having hydraulically actuated pivotal blades which are used to cut a pipe and to mill a section or window in casing. Such a mill is normally used for milling windows for cased hole side track operations or gravel pack completions.

Figure 4:
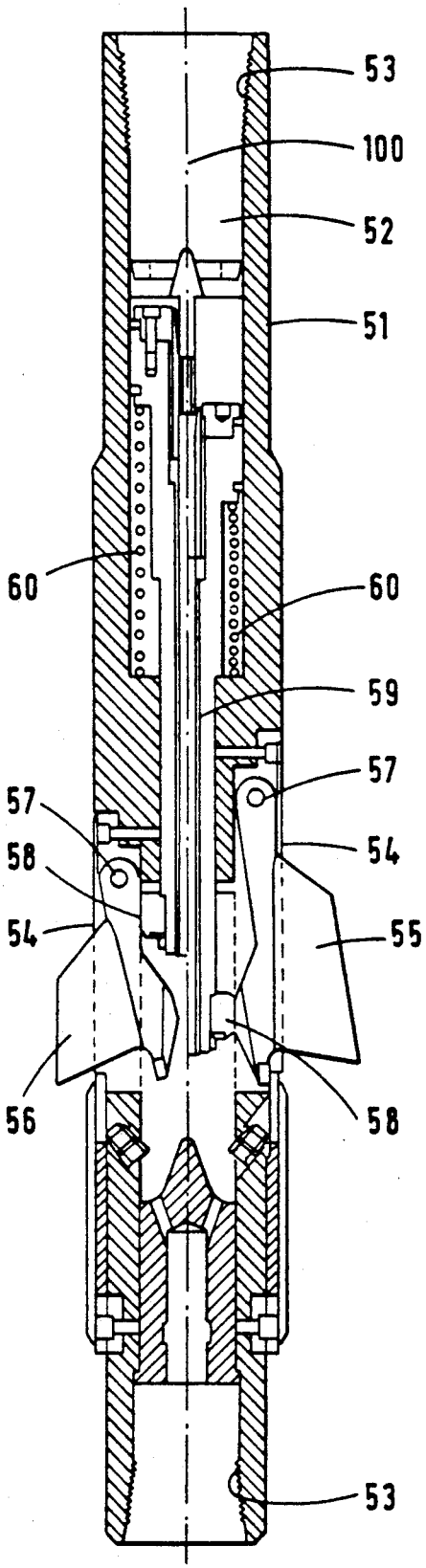

The section mill shown in FIG. 4 has a circularly cross-section body 51 having an axial passage 52 therethrough for the circulation of mud and the upper and lower ends of the body each have an internal screw thread 53 for the connection of the body to a drill string.

The body may have three to twelve equi-circumferentially spaced longitudinal slots 54 provided in the outer circumference thereof, six such slots being currently preferred and shown in the embodiment of FIG. 4. Three axially long cutters 55 interspaced by three axially short cutters 56 are each mounted on a respective pivot 57 in each of the slots 54, and a respective cam 58 carried by circulating fluid operated piston 59 acts on the cutters 55, 56 so that the cutters are pivotally radially movable away from the body 51 to a cutting position, the cutter 55 only being shown radially extended. The piston 59 is biased by a compresion of spring 60. Such a mill is disclosed in UK Patent No. 834,870 and in the prior art the leading surface of the blades 55, 56 are dressed with crushed tungsten carbide.

In operation the tool is rotatable about a longitudinal axis 100 and the short cutters 56 are arranged to open before the cutters 55, the position of the cam 58 on the blade 55 being shown for the purposes of explanation only and in reality the two cams 58 will be adjacent one another.

Figure 5A:
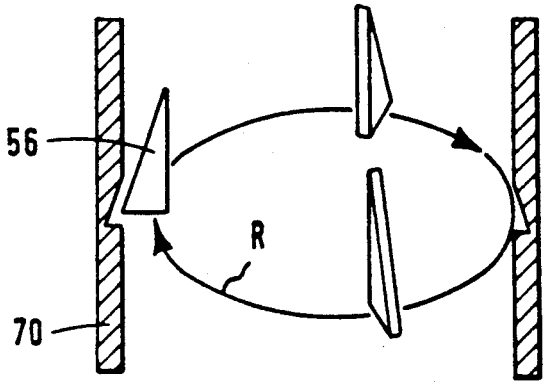
Figure 5B:
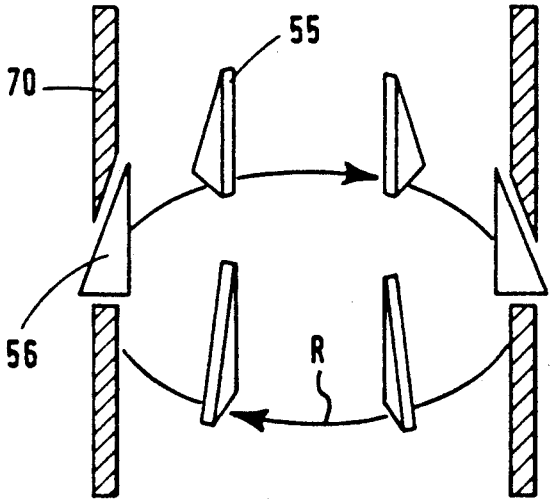

Thus by virtue of the shape of the inner surface of the blade upon which cam 58 acts and by virtue of the shorter cutter 56 having its pivot point lower than the pivot of the longer cutter 55 so the shorter cutters 56 are opened first and faster than the longer cutters 55. Such a situation is shown in FIG. 5*a* where the shorter cutters having opened to part a pipe or casing 70. When the blades are all fully opened, as shown in FIG. 5*b*, all of the blades participate in the subsequent milling effect. The fact that a pipe has been completely cut is indicated by a reduction of the surface stand pipe pressure and increase in the rate of flow of mud.

Typically 4000 to 8000 lbs of weight (1814 to 3629 kg) are applied to the mill and the rotational speed may be 100 to 125 rpm. When the casing has been cut in the desired section or the desired section of casing has been milled the tool rotation is ceased and the spring 60 lifts piston 59 thereby withdrawing the cams from between the blades 55, 56 so that the blades are free to collapse into the body 51 and the tool can then be pulled into the casing shoe and retrieved.

Figure 6:
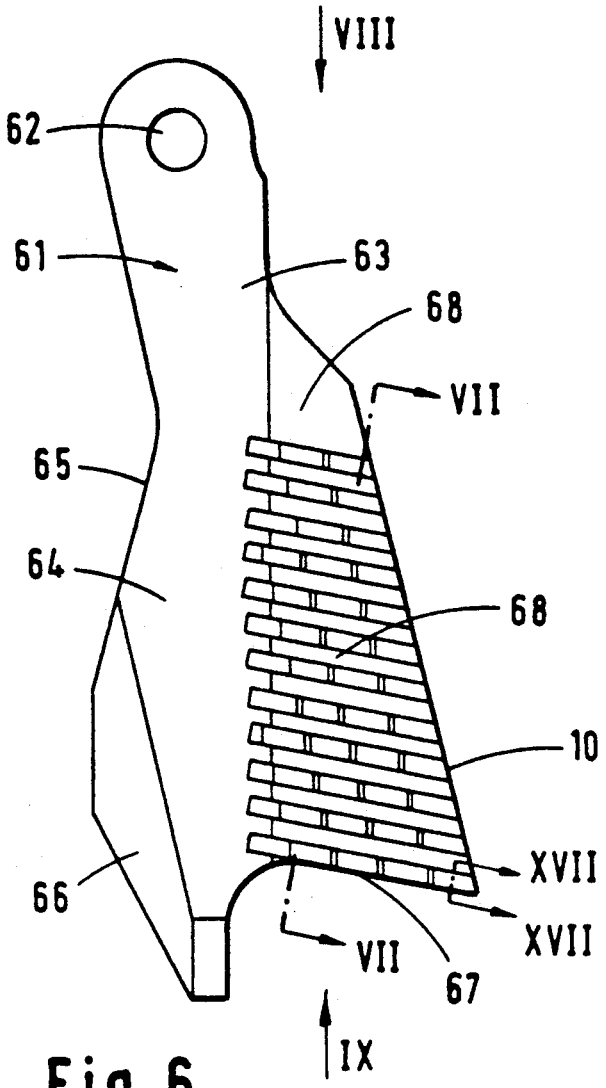

One of the cutters 55, 56, constructed in accordance with this invention is shown in detail in FIGS. 6–9 and has a longitudinally extending blade 61, the upper end, as shown in FIG. 6, being provided with a circular hole 62 through which the pivot 57 is located. The blade 61 has a necked portion 63 in which the hole 62 is situated which broadens out to a main portion 64, a radially inner side 65 along which the cam 58 abraids, linking to an approximately triangularly cross-sectioned rib 66. The lower part of the blade 61 has an L-shaped cutout to provide a lower, in use, edge 67.

Located over the leading surface 68 of the blade, i.e. facing forwardly in the direction of rotation of the tool, are the slots 12 in which the cutting elements 13 are disposed in similar fashion to the disposition of the slots and cutting elements in the mill shown in FIGS. 1–3. One of the slots is shown empty for illustration purposes only. The radial outer edge 10 is arranged to have a clearance angle B in the range 5°–10° depending on the size of the casing to be cut.

Figure 13:
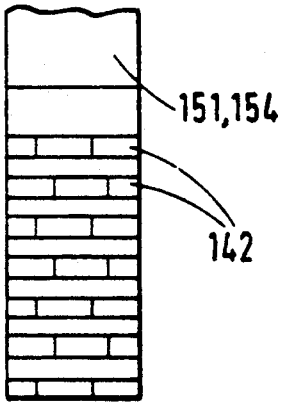
Figure 14:
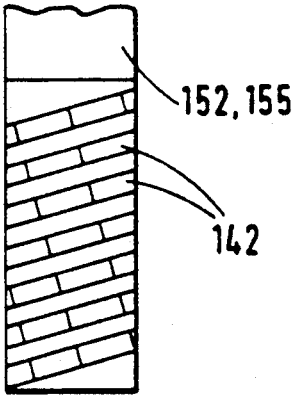
Figure 15:
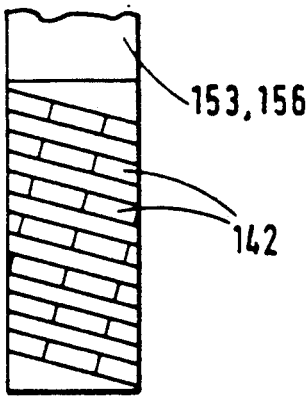
Figure 16:
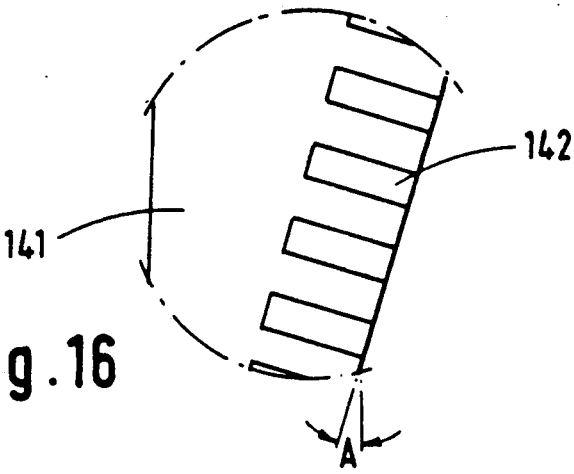

A washover shoe embodiment of the present invention will now be described by way of example with reference to FIGS. 10–17. Referring particularly to FIGS. 10–17 a tubular body 140 has welded around the lower peripheral edge thereof six, for example, blades 141 which each have an upper portion that is slotted to permit the lower edge of the body 140 to enter the slot. Although in the presently described embodiment the blades are shown as being separately formed and welded to the body, it is envisaged that the blades could be formed as a unitary part of the body. As shown in FIGS. 13, 14 and 15, the blades are each slotted in a radial direction of the blade and, as shown in FIG. 16, in a direction of intended rotation of the drilling string, FIG. 16 also showing the negative axial rake angle presented by cutting elements 13 secured in each slot, whereby an upper edge of the cutting surface of the elements is tilted towards the direction of body rotation. Moreover, it will be seen from FIGS. 10, 13–16 that a plurality of slots are provided in the direction of the longitudinal axis 100 of the body 140.

Figure 12:
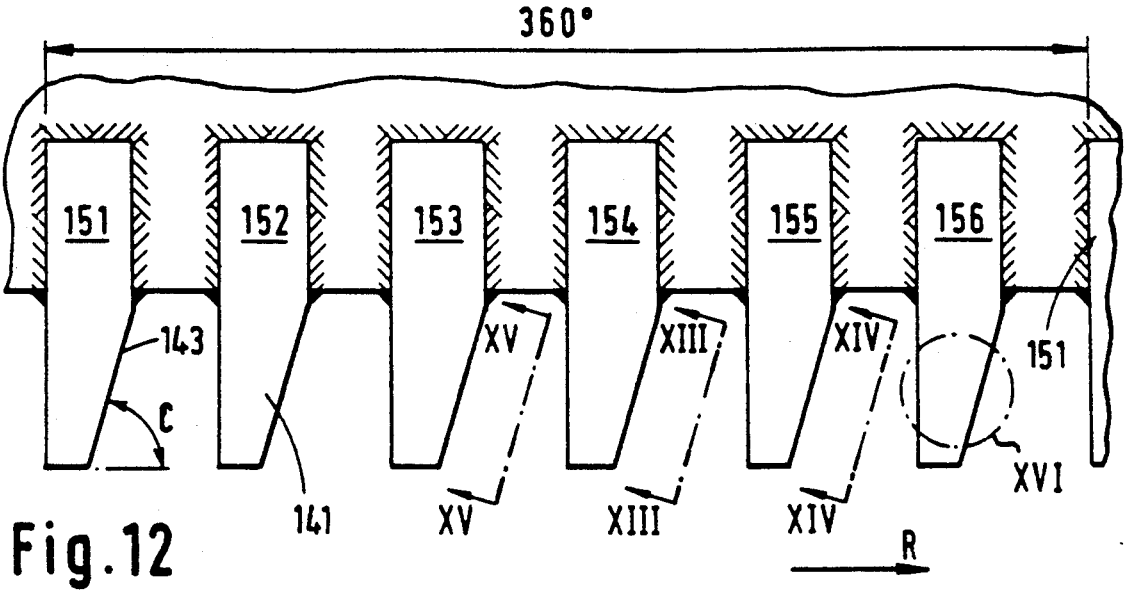

Referring now particularly to FIG. 12, wherein a developed view along the outside diameter of the shoe is shown, it will be seen that an angle C is presented by surface 143 of each blade with respect to a horizontal in the direction of shoe rotation, which angle C is preferably 75°. In FIG. 12 each of the blades has been numbered 151 to 156. As shown in FIG. 13, blades 151 and 154 have cutting elements located in horizontal slots in a plane perpendicular to the body longitudinal axis; FIG. 14 shows that the blades 152 and 155 have cutting elements presenting one angular orientation with respect to the plane perpendicular to the longitudinal axis; and FIG. 15 shows that the slots in blades 153 and 156 present an opposing angle of disposition with respect to the plane perpendicular to the longitudinal axis from the angle presented by slots in blades 152 and 155. The reason for presenting the cutting elements at such different angles is to reduce the width of cuttings and thus facilitate removal of cuttings.

As described thus far the upper 16 and lower 17 surfaces of the slots, and the adjacent major surfaces 14, 15 of the cutting elements 13, have been described as being parallel. Such a construction requires that the slots are cut accurately to a narrow tolerance so that the brazing material in which the cutting elements sit in the slot does not have an excessive thickness. It has been found, however, that with such a construction there is a tendency for a cutting element to fracture in use caused not only by normal wear but, it is believed, by tensile stresses in the brazing material contracting during cooling after use at a different rate to the rate at which the cutting element and the material of the blade contracts, causing the cutting element to tear apart.

Figure 7:
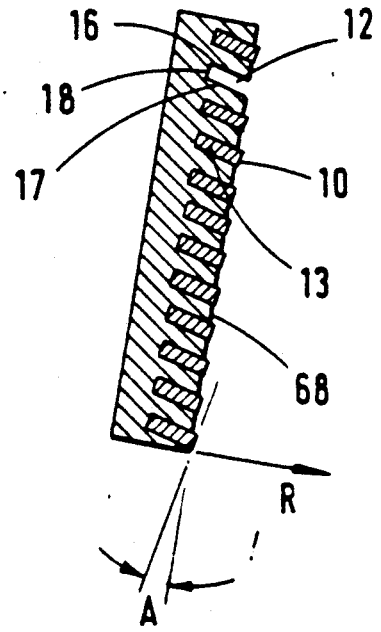
Figure 8:
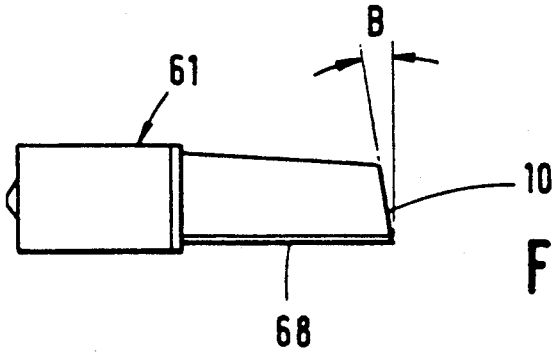
Figure 9:
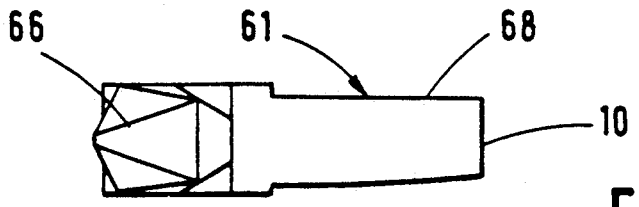
Figure 10:
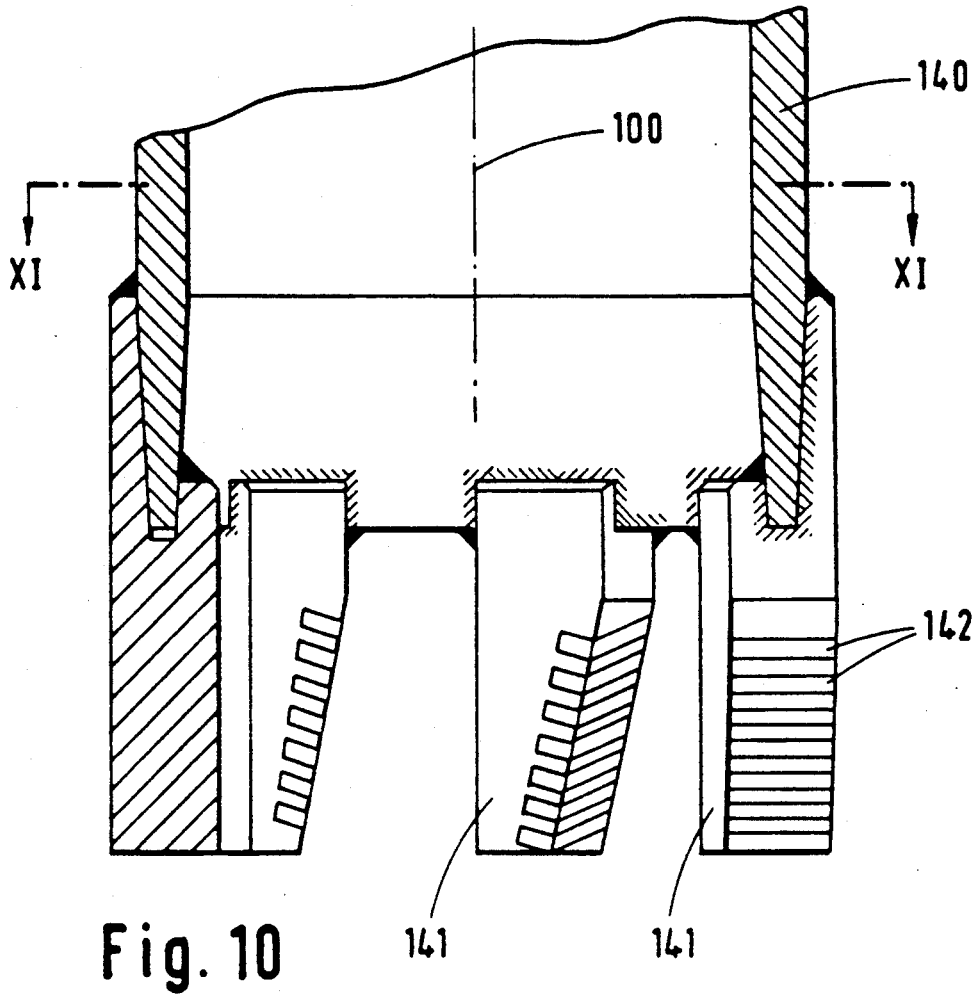
Figure 11:
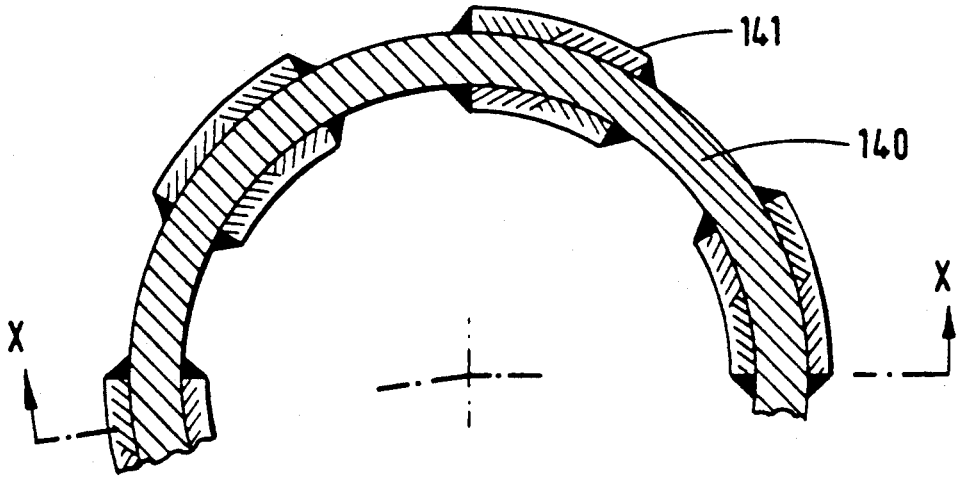
Figure 17:
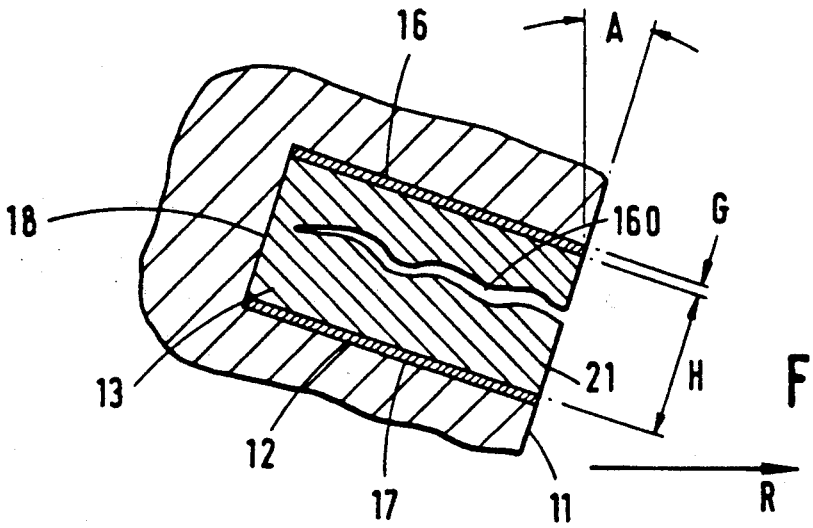
Figure 18:
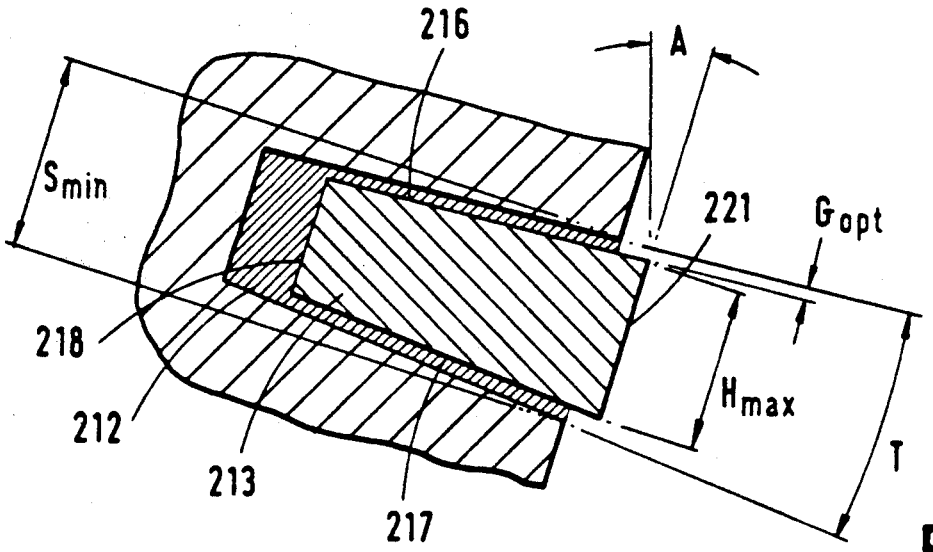

A detail of one such element is shown in a view corresponding to the views of FIGS. 3, 7 and 16 in FIG. 17. In FIG. 18 the tunqsten carbide element 13, which may be identical or similar to those used on workshop lathes, has the leading (front) 21 and rearward edge, with respect to the direction of intended rotation of the tool, completely inserted into the respective slot 12. With the exception of the radially outermost element in each slot, where the outer facing side is not protected, all the cutting elements 13 are brazed against the top 16, bottom 17 and rear 18 of the slots 12 as well as against the two neighbouring elements.

Because of tolerances, the minimum and maximum top 16 to bottom 17 height H of the elements 13 must be arranged to fit inside the minimum and maximum height of the slots 12 and as a result the distance between the top and bottom of the slot, and the top and bottom of the elements, G, will vary greatly.

Due to the differences that occur in production of dimension G it has been found that if there is too much brazing material the contraction thereof during cooling causes tensile stress upon the element 13 so that the element ruptures 160.

Figure 19:
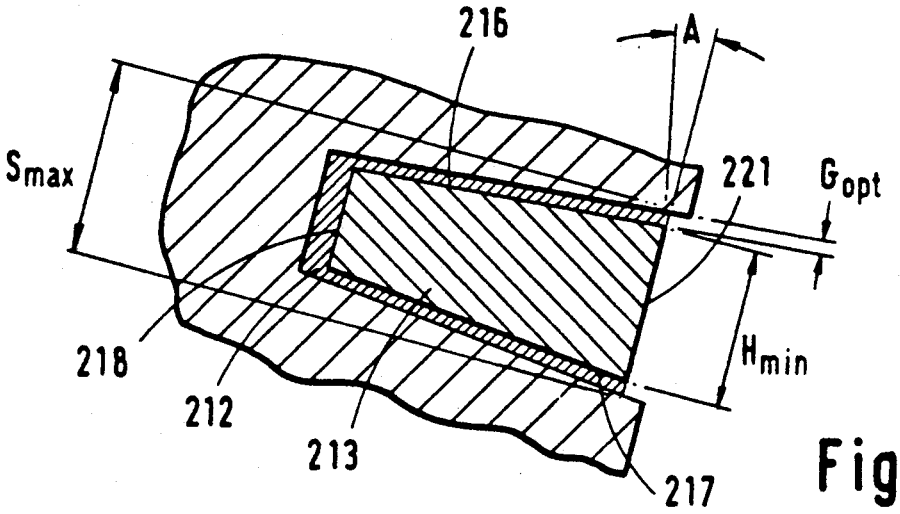

The portion of blades shown in FIGS. 18 and 19 has a slot 212 tapered in the leading to rearward direction of intended rotation R of the tool and the corresponding taper is applied to the cutting element 213. Where elements 213 are located side by side in the slot then the adjacent faces of the elements are preferably parallel to one another. Similarly to the embodiment shown in FIG. 17, the elements are secured into position by being located in brazing material. However, unlike the arrangement of the embodiment of FIG. 17, the distance G is always at an optimum G opt since the element 213 may be pushed further into or out of the slot 212. Thus in the example of FIG. 18, where the height of the slot is at a minimum, S min, and the height of the element 213 is at a maximum, H max, then the element 213 protrudes from the slot. In distinction, in FIG. 19, where the height of the slot is at a maximum, S max, and the height of the element 213 is at a minimum, H min, then the element 213 is simply pushed further into the slot. The front to back angle T is sufficient for capilliary forces to suck brazing material into the gaps between the elements 213 and slot 212 and may be in the range 1° to 20° but preferably in the range 3° to 6°. Thus, brazing material extends over the top 216, bottom 217 and rear 218 of the element 213. Similarly to the blades shown in FIG. 17, the front 221 of the element 213 is arranged to have a negative axial rake angle A although such a rake angle is not essential.

By providing tapered slots and corresponding tapered cutting elements, the optimum thickness G opt is provided between the mating surfaces so that bond quality is improved and unwanted tensile stresses are significantly reduced when differing thermal co-efficients of expansion between the tungsten carbide element 213, the brazing material and the blade occur.

Although it has been described that the negative axial rake angle A is achieved by inclining the slots, it will be realised by those skilled in the art that the axial negative rake angle can similarly be achieved by forming the slots perpendicularly to the leading face of the blade and by inclining the longitudinal length of the blade so that the leading face 11 of the blade 8 or 68 of blade 61 has a negative axial rake angle. The number of slots and the number of cutting elements in each slot has been described and illustrated by way of example and it will be appreciated that different numbers of slots and different numbers and sizes of cutting elements can be used. Additionally, the embodiments have been described in which the cutting elements are quadrilaterial in cross-section when viewed along the longitudinal axis but other cross-sections of cutting element may be employed and it is not intended that the invention be limited to cutting elements which are located in each slot in abutting relationship with one another.

Although the present invention has been described with reference to preferred embodiments, workers skilled in the art will recognise that changes may be made in form and detail without departing from the spirit and scope of the invention.

I claim:

1. A blade for a pipe milling tool adapted to be connected to a rotatable drilling string body having a longitudinal axis, said blade having at least one slot means formed therein extending both in a generally radial direction and in an intended direction of rotation, and at least one cutting element secured in each said at least one slot means, said slot means and said cutting element having a greater depth in said blade in the intended direction of rotation than height in the longitudinal axis direction, said slot means and said cutting element having a ratio of depth to height in the range 2:1 to 4:1.

2. A blade as claimed in claim 1 wherein said slot means and said cutting element are both similarly decreasingly tapered from a forward to a rearward face with respect to the direction of intended rotation of the tool by an angle in the range 1° to 20°.

3. A blade as claimed in claim 2 wherein said angle is in the range 3° to 6°.

4. A blade as claimed in claim 3 wherein the negative axial rake angle is in the range 2°–20°.

5. A blade as claimed in claim 4 wherein the negative axial rake angle is in the range 10°–15°.

6. A blade as claimed in claim 1 wherein a plurality of cutting elements are radially located in each said slot means.

7. A blade as claimed in claim 6 wherein adjacent cutting elements abut one another to provide a substantially continuous cutting edge.

8. A blade as claimed in claim 1 wherein the at least one cutting element has a quadrilateral cross-section when viewed along said longitudinal axis.

9. A blade as claimed in claim 1 wherein said blade is radially connected to said body.

10. A blade as claimed in claim 9 wherein said blade is pivotally radially connected to said body and means are provided for radially extending said blade.

11. A washover shoe having a tubular body and a plurality of blades each blade as claimed in claim 1 positioned around the lower periphery of said body.

12. A washover shoe as claimed in 11 wherein the slot means of adjacent blade means present differing angles to one another with respect to a plane perpendicular to said longitudinal axis.

13. A method of dressing a blade for a pipe well milling took having a body with a longitudinal axis, said body being adapted to be connected to a rotatable drilling string, said method including the steps of forming at least one slot means in the blade in a generally radial direction to said longitudinal axis and to an intended direction of rotation of said blade, said slot means having a greater depth in the intended direction of rotation than h eight in the longitudinal axis direction, inserting at least one cutting element into said slot means, said cutting element having similar depth and height dimensions to said slot means, said slot means and said cutting element are similarly both decreasingly tapered from a forward to a rearward face with respect to the intended direction of rotation of the tool, said cutting element being secured within said slot means.

14. A blade for a pipe milling tool adapted to be connected to a rotatable drilling string body having a longitudinal axis, said blade forming at least one slot means formed in said blade through an outer longitudinally extending wall, said slot extending generally radially inwardly from said wall, said slot means being quadrilaterally shaped when viewed along said longitudinal axis, said slot extending both in a generally radial direction and in an intended direction of rotation, and at least one quadrilaterally shaped cutting element secured in each said at least one slot means, said slot means and said cutting element having a greater depth in said blade in the intended direction of rotation than height in the longitudinal axis direction.

15. A blade as claimed in claim 14 wherein the ratio of depth to height is in a range of 2:1 to 4:1.

16. A blade as claimed in claim 14 wherein said at least one quadrilaterally shaped cutting element has a cutting surface presenting a negative axial rake angle whereby an upper edge of the cutting surface is tilted towards the direction of body rotation.

17. A blade as claimed in claim 16 wherein the negative axial rake angle is in the range 2° to 20°.

18. A blade as claimed in claim 17 wherein the negative axial rake angle is in the range 10° to 15°.

19. A blade as claimed in claim 14 wherein a plurality of slot means are provided located one above the other in the direction of the longitudinal axis.

20. A blade as claimed in claim 14 wherein a plurality of cutting elements are radially located in each said slot means.

21. A blade as claimed in claim 20 wherein adjacent cutting elements abut one another to provide a substantially continuous cutting edge.

22. A blade as claimed in claim 14 wherein the at least one quadrilaterally shaped cutting element is made from one of tungsten carbide, industrial diamond, ceramics and boron nitride.

23. A blade as claimed in claim 14 wherein said blade is radially connected to said body.

24. A blade as claimed in claim 23 wherein said blade is pivotally radially connected to said body and means are provided for radially extending said blade.

* * * * *